US005144733A

United States Patent [19]

Emmerich

[11] Patent Number: 5,144,733

[45] Date of Patent: Sep. 8, 1992

[54] APPARATUS FOR BONDING AND LAYING CONDUCTORS

[75] Inventor: Herbert Emmerich, Waiblingen/Neustadt, Fed. Rep. of Germany

[73] Assignee: MERZ Metall-und Kunstatoffverarbeitunge, Frankfurt, Fed. Rep. of Germany

[21] Appl. No.: 623,919

[22] PCT Filed: Jun. 16, 1989

[86] PCT No.: PCT/DE89/00400

§ 371 Date: Dec. 17, 1990

§ 102(e) Date: Dec. 17, 1990

[87] PCT Pub. No.: WO89/12919

PCT Pub. Date: Dec. 28, 1989

[30] Foreign Application Priority Data

Jun. 18, 1988 [DE] Fed. Rep. of Germany ..... 3820636

[51] Int. Cl.[5] ..... H05K 13/06

[52] U.S. Cl. ..... 29/564.2; 29/755

[58] Field of Search ..... 29/33 M, 564.1, 564.2, 29/564.6, 564.8, 566.3, 760, 755, 868; 140/92.1, 93 R

[56] References Cited

U.S. PATENT DOCUMENTS

| | | | |
|---|---|---|---|
| 4,399,842 | 8/1983 | Gibbons | 140/92.1 |
| 4,440,053 | 4/1984 | Suzuki et al. | 29/564.6 X |
| 4,593,452 | 6/1986 | Keahey et al. | 29/564.8 X |
| 4,607,430 | 8/1986 | Young | 29/868 |
| 4,653,159 | 3/1987 | Henderson | 29/33 M |
| 4,677,734 | 7/1987 | Bloch et al. | 29/564.2 |
| 4,715,100 | 12/1987 | Cross | 29/755 X |
| 4,860,427 | 8/1989 | Kanaguchi | 29/755 X |

FOREIGN PATENT DOCUMENTS

| | | | |
|---|---|---|---|
| 1185666 | 10/1985 | U.S.S.R. | 29/755 |
| 2059302 | 4/1981 | United Kingdom | 29/755 |

*Primary Examiner*—William Briggs

*Attorney, Agent, or Firm*—Paul and Paul

[57] ABSTRACT

An apparatus is described for bonding and laying conductors by means of a multi-axial positioning unit in which the cable is guided in a laying tube and is advanced by a feed unit. The apparatus according to the invention is characterized by the combination of the following features:

the apparatus comprises a jaw gripper, of which the gripper jaws comprise, extending in the plane of the jaws, recesses which form the laying tube;

the feed unit is integrated into the gripper jaws and is reversible;

provided at the ends of the laying tube are shaping elements which center a contact as the cable is drawn into the laying tube.

13 Claims, 3 Drawing Sheets

APPARATUS FOR BONDING AND LAYING CONDUCTORS

Figure 1A:
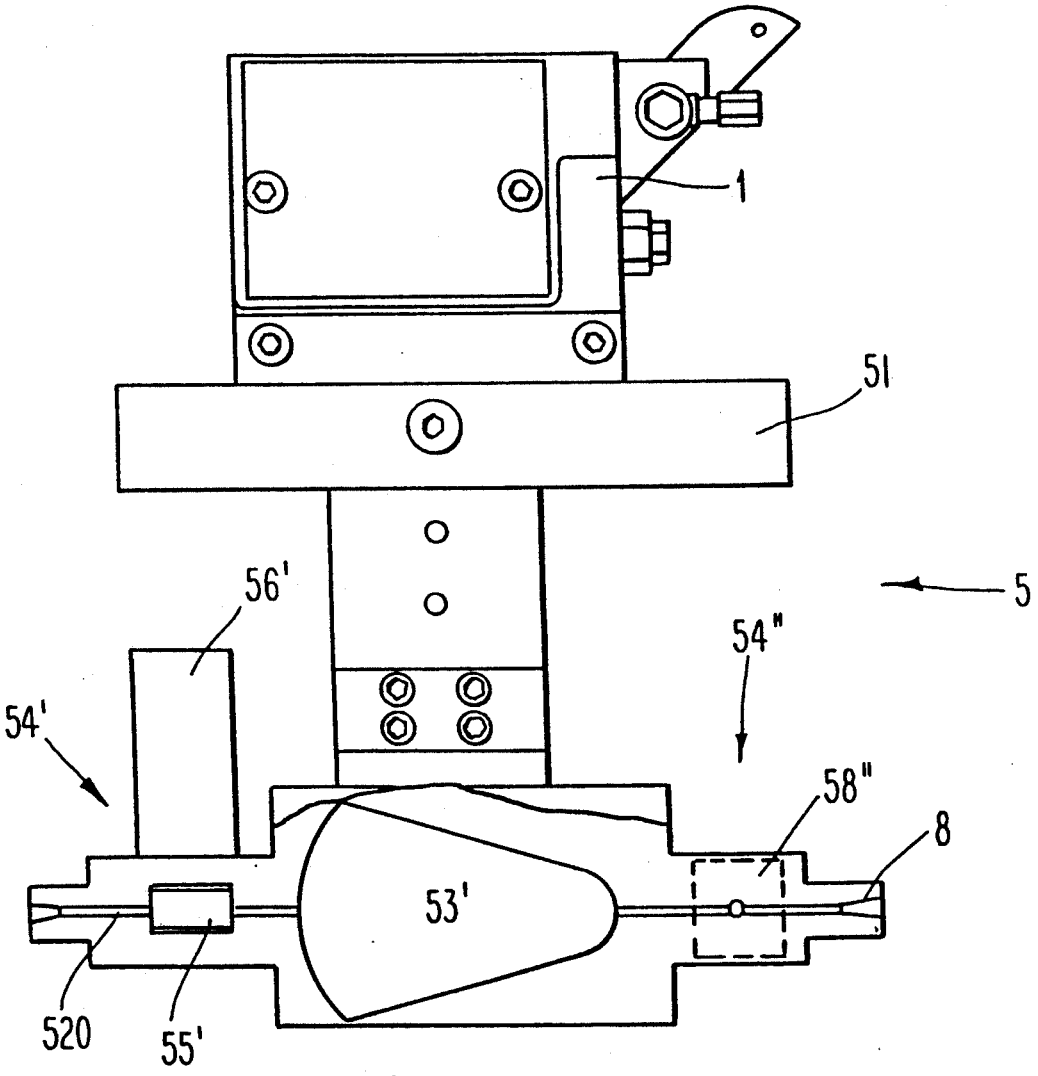

An apparatus is described for bonding and laying conductors by means of a multi-axial positioning unit, wherein the cable is guided in a laying tube and is advanced by a feed unit.

For some considerable time, no appropriate apparatus has been known for automatic bonding and laying of conductors with so-called crimped contacts. Only pilot installations have become known in some isolated instances but they have not become established in industrial practice.

In the case of the pilot installations of Messrs. UNIMATION AND VEKTRONICS, problems occur particularly in the storage of the cable with the attached crimped contact and in handling the cable which is flexurally slack.

Practical solutions have only become known from applications filed by these Applicants and then only for the manufacture of laced wiring loops with 'cut-and-clamp connectors', using cable drums.

The invention is based on the problem of indicating a practical apparatus for bonding and laying conductors by means of a multi-axial positioning unit in which there are no limitations of any kind with regard to the cable contacts, i.e. an apparatus which makes it possible not only to produce laced wiring harnesses with so-called cut-and-clamp connectors but also to manufacture wiring harnesses for example with so-called crimped contacts. According to the invention, a solution to this problem, together with its further developments, is characterised in the Patent Claims.

Surprisingly, this problem is successfully resolved in that the premise adopted is an apparatus such as that described in applications by the same Applicants, in which the manufacture of cable harnesses using the cut-and-clamp technique stand to the fore and in that this generic apparatus is further developed by the combination of the following features:

- the apparatus comprises a jaw gripper, of which the gripper jaws comprise, extending in the plane of the jaws, recesses which form the laying tube;
- the feed unit is integrated into the gripper jaws and is reversible;
- provided at the ends of the laying tube are shaping elements which centre a contact as the cable is drawn into the laying tube.

Further developments of the invention are characterized in the sub-claims:

For example, according to claim 2, the laying tube may comprise a widened-open portion which serves to store the random cable. This widened portion is preferably "pear-shaped".

Furthermore, according to claim 4, there are on both sides of the widened portion a respective feed unit.

Furthermore, according to claim 5, there is upstream of the laying tube in the direction of feed of the cable a further unit with a further feed unit and a unit for reducing the cable to lengths, and in that the jaw gripper is pivotable in respect to the further unit (claim 5).

According to claim 6, this further unit may in addition comprise a cable clamping unit.

Furthermore, the feed unit may comprise a friction wheel and a driven wheel which can be applied in the direction of the friction wheel by means of a pressure-applying unit.

Figure 1B:
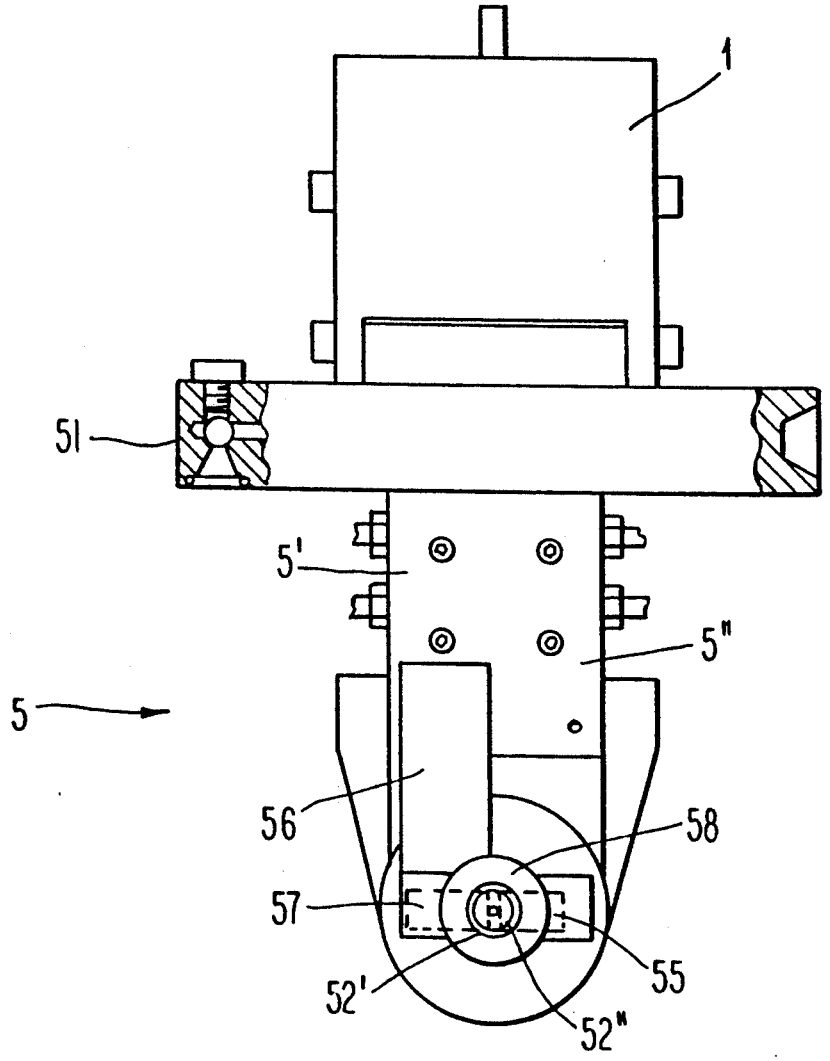
Figure 2A:
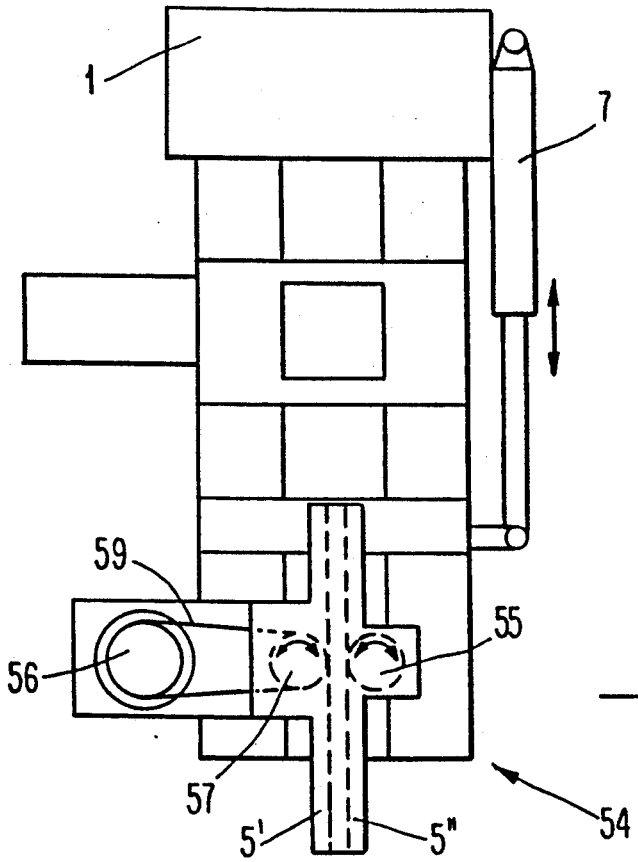
Figure 2B:
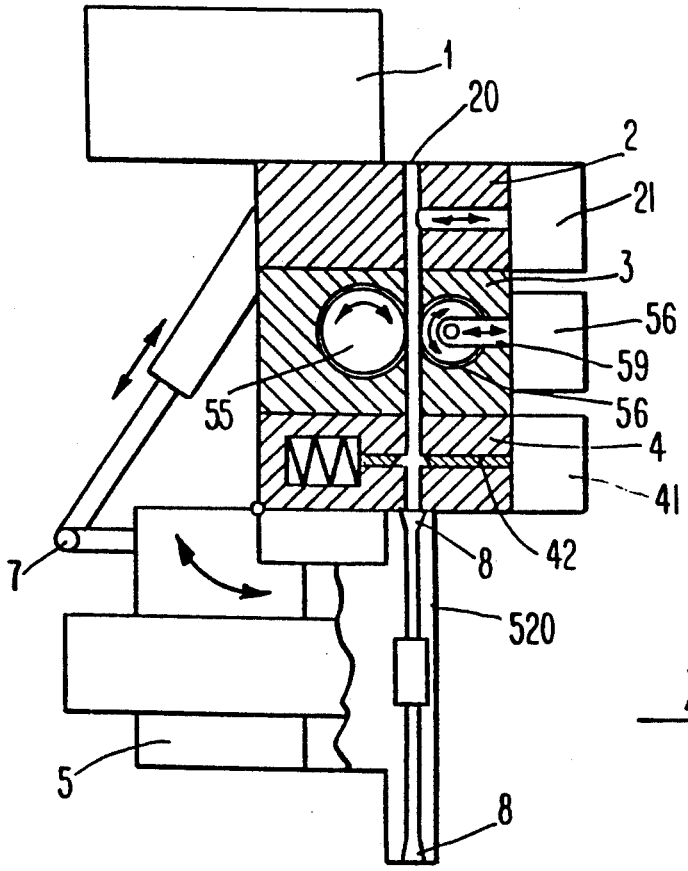

The invention will be described in greater detail hereinafter with reference to examples of embodiment and with no limitation of the general index underlying the invention, reference being made to the drawings, in which:

FIGS. 1*a* and 1*b* are different views of a first example of embodiment of the invention and FIGS. 2*a* and 2*b* show different views of a second example of embodiment.

Both examples of embodiment have in common a tool changing flange 1 and a parallel jaw gripper 5.

In per se known manner, the tool changing flange 1 is the interface between a handling or positioning arrangement, for example an industrial robot, and the actual tool and it ensures transmission of the (electrical, pneumatic and/or hydraulic) energy and the transfer of the various control signals from the control arrangement to the tool or of the sensor signals from the tool to the control arrangement.

The parallel jaw gripper 5 comprises two gripper jaws 5' and 5'' which are articulated on an intermediate flange 51. Each gripper jaw comprises, extending at a right-angle to the direction of movement of the jaws, a recess 52' or 52'' which form a laying tube 520, the diameter of which is greater than the diameter of the largest cable which is to be laid.

In the case of the example of embodiment shown in FIGS. 1*a* and 1*b*, the recesses 52 comprise substantially centrally a "pear-shaped" widened-out portion 53, the function of which will be explained hereinafter. On both sides of the widened-out portion 53 are cable feed units 54 (designated ' and ''), which each consist of a drive wheel 57 driven by a reversible electric motor, the drive wheel 57 being adapted to be pre-tensioned in the direction of the laying tube by a pneumatic cylinder 58.

In the case of the example of embodiment shown in FIGS. 2*a* and 2*b*, only one feed unit 54 is provided and in which, as an example, a V-belt 59 is shown as the connection between the motor 56 and the drive wheel 57.

Furthermore, in the example of the embodiment shown in 2*a* and 2*b*, a further unit is provided with a cable guide tube 20 which consists of a cable clamping unit 2 with a clamping element 21, a further cable feed unit 3 which may likewise comprise elements 55 to 59, and a length-cutting unit 4 with a length-cutting element 42 adapted to be actuated for example by a pneumatic unit 41 and having a counter element 43.

The cable clamping unit 2 serves to clamp securely a cable which is not shown, so that it cannot be withdrawn by the movement of the tool.

The length-cutting unit 4 serves to cut the cable at a clearly defined location, while the feed unit 3 serves to feed the cable in the further unit.

In the case of the example of embodiment shown in FIGS. 2*a* and 2*b*, the parallel jaw gripper 5 can by means of a hydraulic jack 7 be pivoted through at least 90° in respect of the further unit.

The ends of the laying tube 520 have in both embodiments (divisible) shaped elements 8 which permit the "centered" draw-in of a contact, for example of a crimped contact. The shaped elements 8 can for example be exchanged for a dovetail guide so that by exchanging appropriate "contact-specific shaped elements", also wiring harnesses having different contact elements can be assembled. By an appropriate shaping of the shaped elements 8 which may be in particular project beyond the contours of the grippers, it is also possible to equip complicated multi-pole plugs without collision problems.

Initially, a laying process will be described hereinafter, employing the tool shown in FIG. 1 and then using the tool shown in FIGS. 2*a* and 2*b*.

In this respect, with both tools, the adopted premise will be that of an industrial robot, a tool magazine with tools, a laying board with laying aids and plug housings as well as an attaching machine of per se known construction.

FIRST EXAMPLE OF EMBODIMENT

The robot changes the tool via the changing flange 1 from a magazine and positions it in front of a cable feed unit of per se known construction.

When the parallel jaw gripper 5 is closed, the cable is introduced into the laying tube 520 which is formed. By actuating the pneumatic cylinder 58, the cable is clamped between the friction wheel 55' and the counter roller 57. When the motor 56" is not switched on, the cable is thus securing in its position.

By means of the electric motor 56' shown on the right in the drawing but not described in greater detail, the cable is laid into the store 57 from the store tip. This takes place in that the pneumatic cylinder 58 presses the driving roller 57 against the friction wheel 55 and the electric motor 56 is switched on.

By reason of the pear-shaped form of the widened-out portion, the cable which is advanced comes to bear against the walls of the widened-out portion. When the desired length of cable is present in the tool, the cable is cut off in the cable preparation means, not shown.

The cable is then passed on sufficiently that a definite portion still protrudes from the tool.

Now, with the tool and the cable stored in the tool, the positioning unit moves to an insulating machine which insulates the two cable ends which are projecting from the laying tube. The insulated cable ends are then provided with contacts, particularly crimped contacts.

The two electric motors 56 of the feed units 54 are then switched on and the two cable ends with the crimped contacts are drawn into the shaped elements 8 at the ends of the laying tube.

The robot now travels to the first plug housing and attaches the centered contact. The contact is pushed in completely by the electric motor which is disposed on this side. In order to ensure that the contact has fully engaged the plug housing, the direction of rotation of the motor is reversed so that a tractive force is applied to the cable. For example, it can be recognised from the current input of the motor whether or not the contact is fully engaged in the plug housing.

The robot now lays the cable in accordance with the path input into it. For laying, the tool can be tilted through 90° by the robot so that the laying tube is at right-angles to the laying board.

During the laying process, the associated delivery mechanism is relaxed so that the cable is withdrawn from the storage means.

The process of attaching the second cable end then takes place as described above.

Once both contacts have been joined, the gripper is opened so that the laying tube opens along its longitudinal axis and releases the cable.

The robot can now pick up a new cable or change over to a new and equivalent tool in which a cable has already been drawn into the standby magazine.

SECOND EXAMPLE OF EMBODIMENTS

Firstly, the robot changes the tool in which a cable is already present in the cable shaft of the "further unit" and is being prevented by the cable clamping 2 from sliding out of the shaft.

Now the hydraulic jack of the cable feed unit 3 is actuated so that the drive wheel is pressed against the friction wheel. By operation of the electric motor, the cable is passed through the length-cutting unit into the laying tube of the gripper 5. The diameter of the gripper tube is such that the cable has clearance in the laying tube.

Once a definite portion of cable has been delivered, the front end of the cable reaches the feed unit in the parallel jaw gripper which pushes the cable forwards sufficiently that a definite portion protrudes from the laying tube.

Then, the robot travels to an insulating and attaching machine which provides the projecting cable end with a contact. By reversing the electric motor, the contact is drawn into and centred in the shaped element.

The robot then travels to a first plug housing and attaches the centred contact. The electric motor disposed on this side fully inserts the contact. In order to ensure that the contact is fully engaged in the plug housing, the direction of rotation of the motor is reversed so that a tractive force is exerted on the cable. For example, it can be seen from the current input of the motor that the contact is fully engaged in the plug housing.

The insertion process can take place in both the horizontal and vertical positions of the laying process. It is possible thereby to "tilt" the gripper accordingly in relation to the further unit.

The robot now lays the cable in accordance with the path input into it. While this is happening, the cable is "pulled through" the tool.

After the laying stage, the cable is securely clamped by the clamping mechanism 2 and is cut to length by the device 3.

The cable is then secured in its position in the gripper by the feed unit 4 and is advanced sufficiently that a specific portion projects from the laying tube. The cable is now provided with a contact as described previously; this contact is then again "centred" by reversal of the electric motor.

The attachment or joining process when then follows is likewise concluded with a "pull test". When the connection process is completed, the gripper is opened and the cable is thus released.

The next cable can then be laid in the same way.

I claim:

1. An apparatus for the bonding and laying of conductors by means of a multi-axial positioning unit in which the cable is guided in a laying tube and is advanced by a feed unit, characterised by the combination of the following features:

the apparatus comprises a jaw gripper, of which the gripper jaws comprise, extending in the plane of the jaws, recesses which form the laying tube;

the feed unit is integrated into the gripper jaws and is reversible;

provided at the ends of the laying tube are shaping elements which centre a contact as the cable is drawn into the laying tube.

2. An apparatus according to claim 1, characterised in that the laying tube comprises a widened-out portion which serves to store the random cable material.

3. An apparatus according to claim 2, characterised in that the widened-out portion is pear-shaped.

4. An apparatus according to claim 2, characterised in that a feed unit is provided on both sides of the widened-out portion.

5. An apparatus according to claim 1, characterised in that upstream of the laying tube, in the direction of cable feed, there is a further unit with a further feed unit and a unit for reducing cable to lengths and in that the jaw gripper is pivotable in relation to the further unit.

6. An apparatus according to claim 5, characterised in that the further unit additionally comprises a cable clamping unit.

7. An apparatus according to any of claims 1 to 6, characterised in that the feed units comprise a friction wheel and a driven wheel which can be pre-tensioned in the direction of the friction wheel by means of a pressure-applying unit.

8. An apparatus according to claim 7, characterised in that the pressure-applying unit is a pneumatic cylinder.

9. An apparatus according to claim 7, characterised in that a reversible electric motor drives the driven wheel.

10. An apparatus according to any of claims 1 to 6, characterised in that the jaw gripper is a parallel jaw gripper.

11. An apparatus according to any of claims 1 to 6, characterised in that in the ends of the laying tube formed by the gripper jaws there are shaped elements for centering the contacts.

12. An apparatus according to claim 11, characterised in that the shaped elements are interchangeable.

13. An apparatus according to claim 10, characterised in that at the ends of the laying tube formed by the gripper jaws there are shaped elements for centering the contacts.

* * * * *

UNITED STATES PATENT AND TRADEMARK OFFICE

CERTIFICATE OF CORRECTION

PATENT NO. : 5,144,733

DATED : September 8, 1992

INVENTOR(S) : Herbert Emmerich

It is certified that error appears in the above-identified patent and that said Letters Patent is hereby corrected as shown below:

On the title page,

The Assignee should read as follows:

MERZ Metall- und Kunststoffverarbeitungs GmbH

Signed and Sealed this

Twelfth Day of October, 1993

*Attest:*

Bruce Lehman

BRUCE LEHMAN

*Attesting Officer*

*Commissioner of Patents and Trademarks*